US007458430B2

(12) United States Patent
Fyfe

(10) Patent No.: US 7,458,430 B2
(45) Date of Patent: Dec. 2, 2008

(54) ATTACHMENT MEANS FOR DRILLING EQUIPMENT

(75) Inventor: George Fyfe, Lonsdale (AU)

(73) Assignee: Transco Manufacturing Australia Pty Ltd, Lonsdale (AU)

( * ) Notice: Subject to any disclaimer, the term of this patent is extended or adjusted under 35 U.S.C. 154(b) by 43 days.

(21) Appl. No.: 10/542,738

(22) PCT Filed: Jan. 20, 2004

(86) PCT No.: PCT/AU2004/000069

§ 371 (c)(1),
(2), (4) Date: May 22, 2006

(87) PCT Pub. No.: WO2004/065752

PCT Pub. Date: Aug. 5, 2004

(65) Prior Publication Data

US 2006/0260848 A1 Nov. 23, 2006

(30) Foreign Application Priority Data

Jan. 20, 2003 (AU) ..... 2003900227

(51) Int. Cl.
*E21B 21/00* (2006.01)

(52) U.S. Cl. ..... 175/342; 175/382; 175/413; 175/325.4

(58) Field of Classification Search ..... 175/344, 175/342, 382, 396, 406, 412
See application file for complete search history.

(56) References Cited

U.S. PATENT DOCUMENTS 1,526,677 A * 2/1925 Painter ..... 175/254
1,969,040 A 8/1934 Sanderson
1,978,084 A 10/1934 Howard
2,189,040 A * 2/1940 Jones ..... 175/346
4,167,980 A * 9/1979 Saxman ..... 175/374
4,199,035 A * 4/1980 Thompson ..... 175/432
4,280,742 A * 7/1981 Justman ..... 175/325.4
4,662,461 A * 5/1987 Garrett ..... 175/325.4

(Continued)

FOREIGN PATENT DOCUMENTS

DE 3916505 8/1990

(Continued)

OTHER PUBLICATIONS

International Search Report of WO 2004/065752, 3 pages.

*Primary Examiner*—Thomas A Beach
(74) *Attorney, Agent, or Firm*—Olson & Cepuritis, Ltd.

(57) ABSTRACT

The invention is an attachment means for a ground drilling or cutting tool (10) that enables cutting elements (11) to be removably secured to the tool (10). The attachment means include a first surface (13) on the cutting element (11), a second surface (14) on the tool (10) upon which the first surface (11) locates, dowel holes (15) in each of the first and second surfaces, dowels (16) that locate in aligned dowel holes between said surfaces, engagement surfaces (17, 18) on the cutting element and tool that extends substantially parallel to the longitudinal axis of the tool and engage to resist side loads applied to the cutting elements (11) and fastening means (19) that secures the cutting elements (11) to the tool (10). The invention provides a means of easily removing the cutting elements (11) from the tool (10) for either replacement or maintenance work.

14 Claims, 3 Drawing Sheets

U.S. PATENT DOCUMENTS 5,027,914 A * 7/1991 Wilson ..... 175/406
5,439,068 A * 8/1995 Huffstutler et al. ..... 175/356
5,467,836 A * 11/1995 Grimes et al. ..... 175/401
5,655,612 A * 8/1997 Grimes et al. ..... 175/401
6,131,676 A * 10/2000 Friant et al. ..... 175/371
6,260,636 B1 * 7/2001 Cooley et al. ..... 175/408

FOREIGN PATENT DOCUMENTS

FR 2609750 7/1998
GB 2294715 5/1996

* cited by examiner

ATTACHMENT MEANS FOR DRILLING EQUIPMENT

This application is the National Stage of International Application No. PCT/AU2004/000069 filed on Jan. 20, 2004, which is incorporated herein by reference.

This invention relates to an attachment means for drilling equipment and in particular to means of attaching cutting elements to the ground drilling or cutting tool.

BACKGROUND OF THE INVENTION

Some ground drilling or cutting tools comprise one or more cutting elements and it is desirable for those cutting elements to be replaceable. This enables damaged cutting elements to be replaced or worn cutting elements to be removed for re-work.

The working conditions for drilling equipment are exceedingly arduous and it is very difficult to construct drilling equipment so that the cutting elements are removable. The most reliable and easiest way of attaching cutting elements to a cutting tool is to fix them in place by welding.

For example, a cutting element may comprise a roller cone which is rotatably secured to an arm and the arm is in turn welded to the body of the drilling or cutting tool. A number of such cutting elements may be spaced around the periphery of the drilling or cutting tool.

Welding of the cutting elements to the cutting or drilling tool presents some difficulty in maintaining the cutting element. Massive rotary drilling tools can each have a large number of cutting elements that will each require, on a periodic basis, to be re-worked or replaced. Obviously, in the case of a welded cutting element, the re-working must occur with the cutting element in situ. Given that some drilling and cutting tools may be quite large, such an operation becomes quite a task.

In addition, when the cutting elements finally become unserviceable, then it is more likely for the drilling or cutting tool to be discarded in its entirety rather than attempting to rework the tool by removing cutting elements.

Accordingly, it is an object of this invention to overcome the abovementioned difficulties and to provide a means of attachment for cutting elements which enable convenient removal of the cutting element as and when required.

SUMMARY OF THE INVENTION

In one aspect, the invention is an attachment means for a ground drilling or cutting tool that enables cutting elements to be removably secured to said tool, said attachment means including:

- a first surface on said cutting element,
- a second surface on said tool upon which said first surface locates,
- dowel holes in each of said first and second surfaces that align when said first and second surfaces locate together,
- a dowel that locates in said aligned dowel holes,
- engagement surfaces on said cutting element and said tool that, extend substantially parallel to the longitudinal axis of said tool, and engage to resist side loads applied to said cutting elements, and
- fastening means securing said cutting element to said tool.

Preferably, the first surface on the cutting element is on an arm of the cutting element and it is parallel with the longitudinal or rotational axis of the drilling or cutting tool. Preferably, engagement surfaces comprise a recess or channel which is located on the drilling or cutting tool and a projection to engage the recess or channel on the cutting element.

The engagement surfaces may also comprise a slot on the drilling or cutting tool and an elongate ridge on the first surface which locates within the slot.

The cutting element may also be secured to a mounting box where the first surface is on the mounting box. The arm of a roller cutter may be welded into the box.

The dowels locate within each of the dowel holes and resist movement in a direction that is parallel to the longitudinal axis of the drilling or cutting tool. Preferably, the fastening means comprises a plurality of bolts which locate through corresponding holes in the first surface and engage in threaded holes within second surface. Preferably, clearance is provided between the holes in the first surface and the bolts so that minimal shear loading is applied to the bolts. Instead, shear forces along the longitudinal axis of the drilling or cutting tool are restrained by the dowel. This prevents damage to the bolts which may in turn create difficulty with disassembly.

In order to fully understand the invention, preferred embodiments will be described. However, it should be realised that the invention is not to confine to the precise combination of elements described in the embodiments and that other variations will be readily apparent to a skilled addressee while remaining within the scope of the invention disclosed in this specification.

BRIEF DESCRIPTION OF THE DRAWINGS

These embodiments are illustrated in the accompanying representations in which.

DETAILED DESCRIPTION

The embodiments described and shown in the representations are generally used in relation to a drilling or cutting tool similar to that described in an earlier application PCT/AU01/01260. The drilling or cutting tool described in that application is known as a hole opener or hole reamer. The cutting tool acts to open a small diameter hole to a larger diameter and uses multiple conical roller cutters to achieve cutting of the rock or earth. This embodiment relates to the attachment of those roller cutters to the main body of the hole opener.

Figure 1:
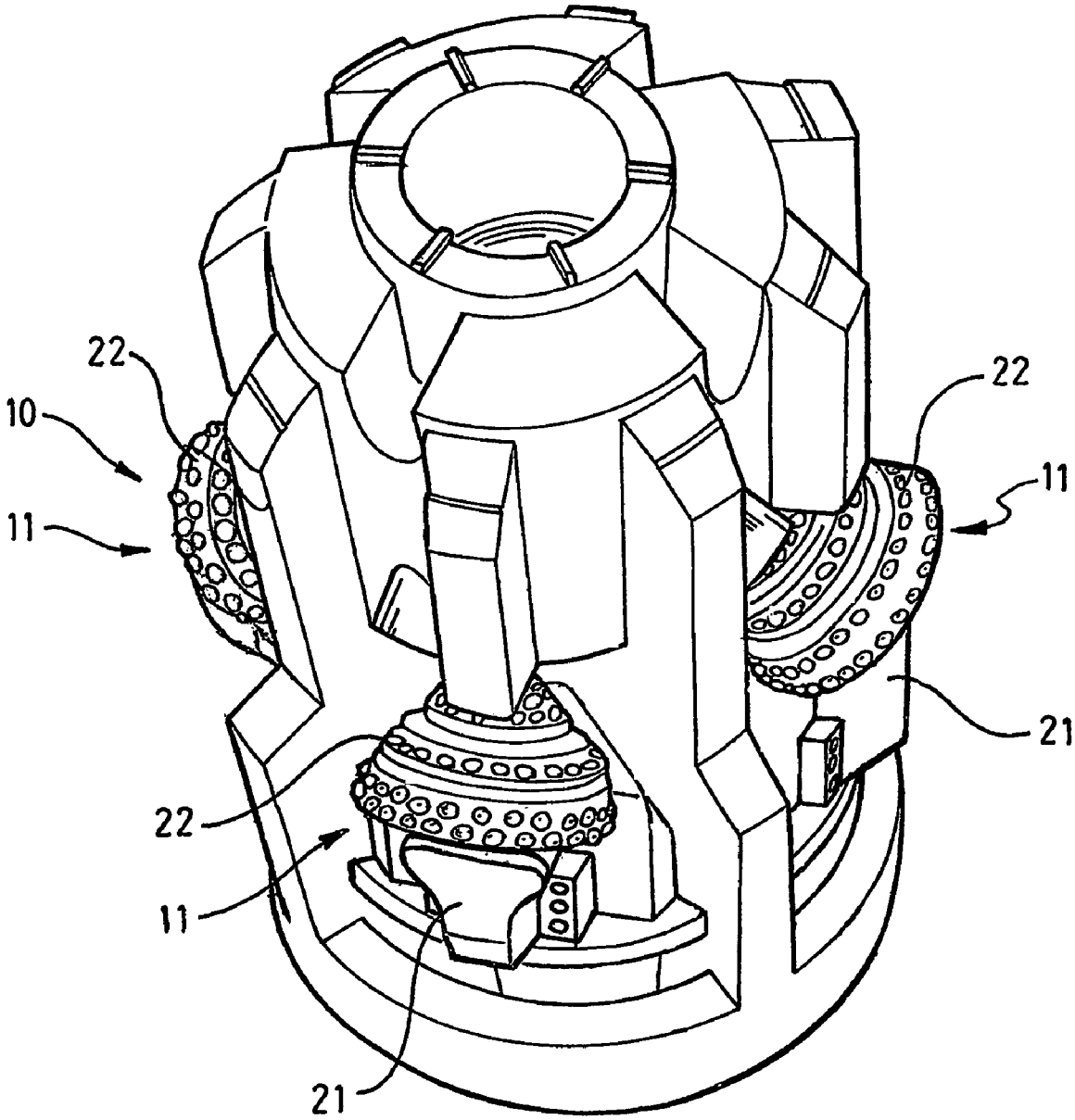
FIG. 1 shows a perspective view of a cutting tool.

FIG. 1 shows a drilling tool 10 incorporating the number of cutting elements 11 around the periphery of the tool 10. In this embodiment, the cutting elements 11 comprise conical roller cutters.

Figure 2:
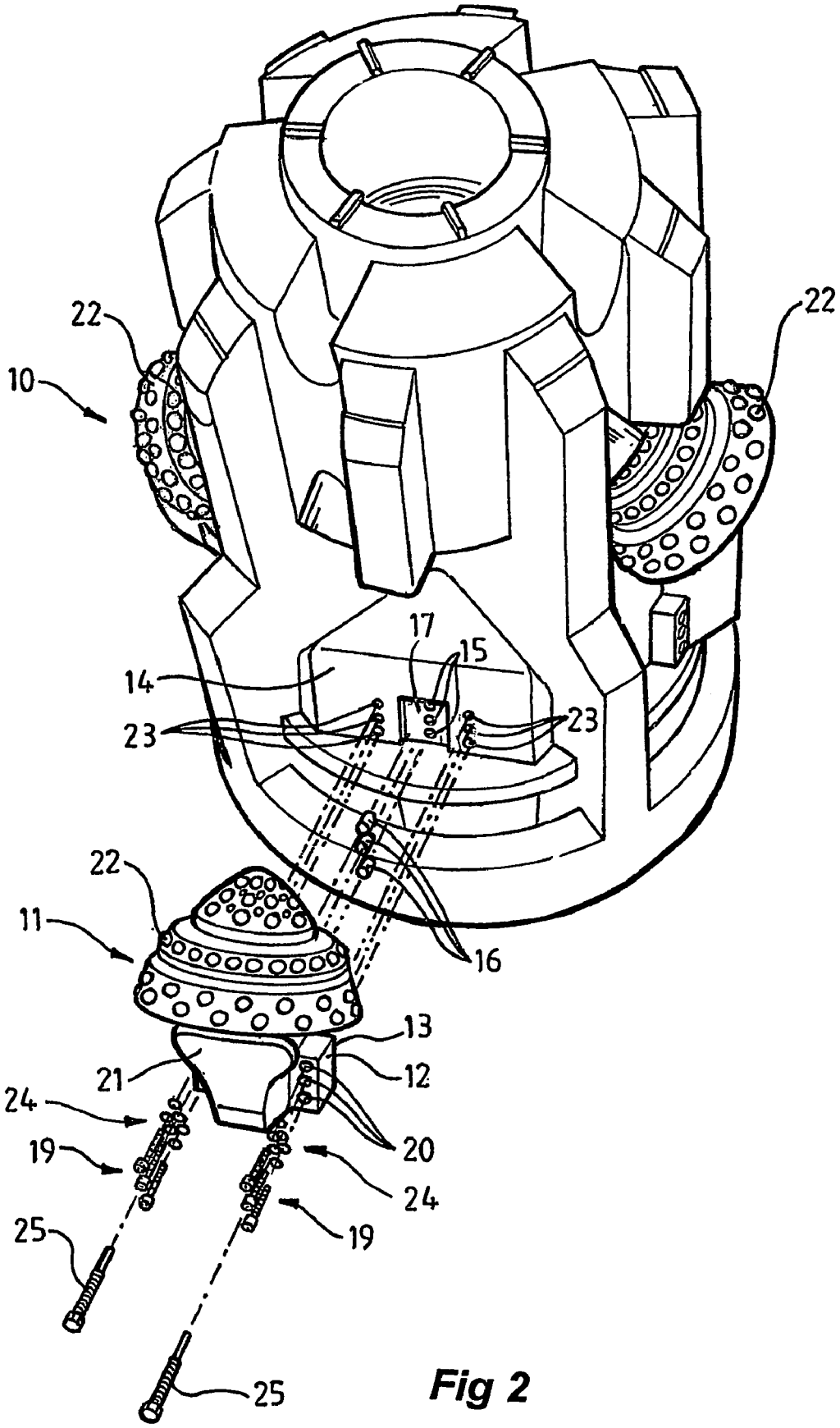
FIG. 2 shows a perspective view of a cutting system with the attachment means shown in exploded view.
Figure 3:
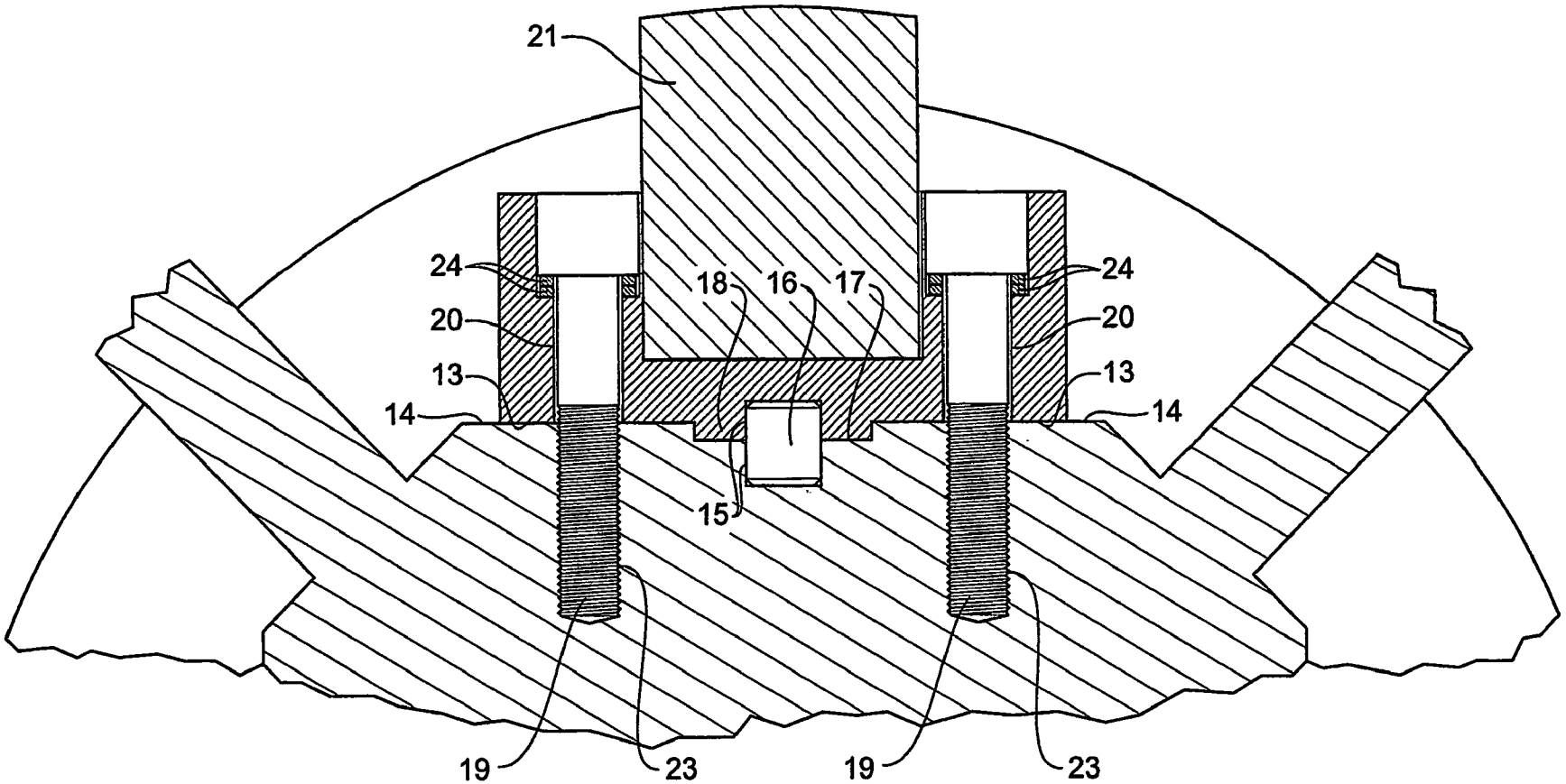
FIG. 3 shows a cross-section view of an attachment means.

As seen in FIG. 2, an attachment means is used to fix the cutting elements 11 to the drilling tool 10. In this embodiment, the cutting elements 11 comprise an arm 21 extending from a roller cutter 22, and the arm 21 is secured to a mounting box 12. The arm 21 is welded to the mounting box 12.

The first surface on the cutting element 11 comprises the generally planar face 13 on the mounting box 12 that abuts against the second surface on the drilling tool 10 which comprises the abutment surface 14. Dowel holes 15 are formed in both the planar face 13 and the abutment surface 14 on both the mounting box 12 and the drilling tool 10. Dowels 16 locate within the dowel holes 15 and both the planar face 13 and abutment surface 14, and are a light interference fit with the dowel holes 15.

The abutment surface 14 has a channel 17 and the dowel holes 15 are located centrally within the channel 17. The planar face 13 of the mounting box 12 has an elongate projection 18 that fits tightly within the channel 17. Clearly, this arrangement could be reversed with the abutment surface 14 incorporating a respective elongate projection which mates with a corresponding channel located on the planar face 13 of mounting box 12.

The fastening means in this embodiment comprises a plurality of bolts 19 and washers 24 that locate through the mounting box 12. Washers may be of the standard slit lock or serrated variety. In this embodiment NORD-LOCK™ self locking washers are used. Bolts 19 threadably engage within apertures 23 in the abutment surface 14. The apertures 20 within the mounting box 12 are counter-sunk and are drilled to a diameter to provide clearance between the shaft of the bolt 19 and the aperture 20. In use, this assists in preventing or minimising shear loads being applied to the bots 19. Instead, the dowels 16 resist the majority of any shear load which results from drilling forces applied to the cutting elements 11 along the longitudinal axis of the drilling tool 10.

In order to assemble the attachment means to the drilling tool 10, dowels 16 are located within the dowel holes on the abutment surface 14. The mounting box 12 is then positioned so that the dowels locate within dowel holes 15 in the planar surface 13 and so that the elongate projection 18 locates within the channel 17. The bolts 19 are then engaged in the apertures 20 and tightened.

Any drilling forces longitudinal to the drilling tool 10 are transmitted as shear forces primarily to the dowels 16. The clearance between the bolts 19 and the apertures 20 minimise any shear loading applied to the bolts 19. As the drilling tool rotates, any side forces applied normal to the logitudinal axis of the drilling tool are resisted by the engagement of the elongate projection 18 within the channels 17.

The cutting elements 11 can be easily removed from the drilling tool 10 by reversal of the above-described assembly process. To further facilitate removal of cutting element 11, jacking bolts 25 are screwed into the middle pair of apertures after removal of bolts 19. This pair of apertures is modified to include a screw thread which threadably engages with the shafts of jacking bolts 25. As jacking bolts 25 are screwed in they function to force mounting box 12 from abutment surface 14. This thereby simplifies the removal process for maintenance purposes particularly when compared with mounting of the cutting elements 11 to a drilling tool 10 by welding.

In a second embodiment (not illustrated), the arm of the cutting element 11, instead of being welded to a mounting box 12, may be arranged to secure directly to the drilling tool 10. In this case, the planar face 13 and associated elongate projection 18 would be on the arm 21 of the cutting element 11 and therefore would mount directly to the abutment surface 14.

Further, as an alternate to the use of a channel 17 and elongate projection 18, both the mounting box 12 in accordance with the first embodiment or the arm of the cutting element 11 in accordance with the second embodiment may locate within a channel having side walls that abut against either the mounting box 12 or the arm of the cutting element 11 so as to resist sideways loads.

With both of the embodiments, it is possible to easily remove the cutting elements for either replacement or maintenance work. As minimal loads are directly applied to the bolts holding the cutting element to the tool, there is less possibility of damage being caused to the bolts resulting in them being easier to remove.

The invention claimed is:

1. An attachment device for a ground drilling or cutting tool that enables cutting elements to be movably secured to said tool, said cutting elements having a cutter and an arm that has a longitudinal axis, a first surface defining a dowel hole, and an engagement surface that extends substantially parallel to the longitudinal axis, said attachment means including:

a second surface on said tool upon which said first surface locates, defining a dowel hole aligned with the dowel hole in the first surface when said first and said second surfaces locate together, a dowel that locates in said first and said second dowel holes when the dowel holes are aligned with one another;

said tool and said cutting element having engagement features that include a projection received in a channel so as to resist side loads applied to said cutting-element, a plurality of threaded fasteners having a preselected diameter, for securing said arm to said tool, threaded apertures defined in said second surface of said tool, on either side of said engagement features, that are threadingly engaged by said threaded fasteners, portions of said arm disposed on either side of said cutting element and on one side of said cutter, defining through holes extending through said arm, to receive and locate said threaded fasteners for threading engagement with said tool; and said through holes providing clearance between the arm and said threaded fasteners so that said threaded fasteners are substantially disengaged from loading applied through said arm to at least one of said dowel and said engagement features.

2. An attachment device according to claim 1 wherein said cutting element comprises a conical roller cutter that is attached to said arm.

3. An attachment device according to claim 2 wherein said dowel is normal to both said first and second surfaces.

4. An attachment device according to claim 3 wherein there are at least two dowels.

5. An attachment device according to claim 1 wherein said cutting element includes said projection.

6. An attachment device according to claim 5 wherein said recess comprises a longitudinal channel.

7. An attachment device according to claim 6 wherein said channel has a base that is parallel to one of said first and said second surfaces, and side walls that are substantially normal to said base.

8. An attachment device according to claim 7 wherein said projection has a shape complementary to the internal shape of said channel.

9. An attachment device according to claim 8 wherein said channel is on said second surface.

10. An attachment device according to claim 1 wherein said arm is formed as part of a mounting box containing said first surface.

11. An attachment device according to claim 1 wherein said threaded fasteners have enlarged heads engaging said arm.

12. An attachment device according to claim 11 wherein said first surface defines portions of said through holes.

13. An attachment device according to claim 1 wherein the engagement features cooperate with the dowels to resist side loads applied to said cutting element.

14. An attachment device according to claim 1 wherein the arm is disposed below said cutter.

* * * * *